US006945335B2

(12) United States Patent
Suzuki et al.

(10) Patent No.: US 6,945,335 B2
(45) Date of Patent: Sep. 20, 2005

(54) OIL-PRESSURE CONTROLLING DEVICE FOR EARTHMOVING MACHINE

(75) Inventors: Kazuyuki Suzuki, Hirakata (JP); Takeshi Takaura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/958,247

(22) Filed: Oct. 6, 2004

(65) Prior Publication Data

US 2005/0167129 A1 Aug. 4, 2005

(30) Foreign Application Priority Data

Oct. 6, 2003 (JP) ..... 2003-347211

(51) Int. Cl.[7] ..... E02F 3/85

(52) U.S. Cl. ..... 172/812; 91/448; 91/531

(58) Field of Search ..... 172/811–813, 818, 172/821–823, 826, 831; 91/531, 448, 519, 91/521, 525, 527, 530, 532; 60/468, 451, 60/433, 434, 445, 449, 452, 368, 450, 443

(56) References Cited

U.S. PATENT DOCUMENTS

| | | | | |
|---|---|---|---|---|
| 5,085,051 | A | 2/1992 | Hirata | 60/368 |
| 5,630,317 | A | 5/1997 | Takamura et al. | 60/445 |
| 6,481,506 | B2 | 11/2002 | Okada et al. | 172/812 |
| 2003/0005691 | A1 | 1/2003 | Kita et al. | 60/451 |

FOREIGN PATENT DOCUMENTS

| | | |
|---|---|---|
| JP | 2002-275931 | 9/2002 |

*Primary Examiner*—Christopher J. Novosad
(74) *Attorney, Agent, or Firm*—Wenderoth, Lind & Ponack, L.L.P.

(57) ABSTRACT

An optimal pump flow for both dual tilt operations and single tilt operations is obtained at low cost without increasing the complexity of the device constitution. Where there is a wish to implement a dual tilt operation, a switch is selectively operated and, in accordance with this selection result, the differential pressure set value decreases and a comparatively small flow is supplied from the hydraulic pump to the left and right tilt cylinders. Accordingly, the extension/retraction speed of the left and right tilt cylinders decreases. Where there is a wish to implement a single tilt operation, a switch is selectively operated and, in accordance with this selection result, the differential pressure set value increases and a comparatively large flow is supplied from the hydraulic pump to the left cylinder. Accordingly, the extension/retraction speed of the left tilt cylinder increases. In this way, the tilt operating speed of the blade in dual tilt operations is made to be the same as the tilt operating speed of the blade in single tilt operations. By virtue of this, when a changeover is implemented from a dual tilt operation to a single tilt operation (or when the reverse changeover thereto is implemented), the operating speed of the blade 3 is unaltered and the discomfort associated with the alteration of the operating speed when this changeover is implemented can be alleviated. Accordingly, the operability throughout the working of the bulldozer is markedly improved.

6 Claims, 7 Drawing Sheets

OIL-PRESSURE CONTROLLING DEVICE FOR EARTHMOVING MACHINE

BACKGROUND OF THE INVENTION

1. Field of the Invention

The present invention relates to an oil-pressure controlling device for an earthmoving machine that performs a load sensing control in which the pressure differential between the discharge pressure of a hydraulic pump and the load pressure of hydraulic actuators are maintained at a set value.

2. Description of the Related Art

FIG. 2 is a perspective view of the peripheral parts of a blade provided in the front part of the chassis of a bulldozer.

The bulldozer carries out work including the digging and shifting of earth as well as the leveling of the ground surface following digging using a blade 3 (moldboard) attached to the front part of the vehicle main body.

A left and right pair of tilt cylinders 4, 5 are provided between the blade 3 and the vehicle main body.

When the two tilt cylinders 4, 5 are simultaneously extension-driven in the same direction the blade 3 is moved to either a pitch dump position (forward tilt position) or a pitch back position (backward tilt position).

In addition, when one tilt cylinder is extension-driven with the other tilt cylinder in the stationary state, the blade 3 is moved to a position in which either the right-end part or the left-end part thereof tilts downward (left tilt position or right tilt position). This is known as a single tilt operation.

In addition, when one tilt cylinder is extension-driven and the other tilt cylinder is simultaneously retraction-driven, the actuation speed of the tilt operation of the blade 3 increases. This is known as a dual tilt operation. Japanese Patent Application Laid-Open No. 2002-275931 provides a description of the elements comprising the implementation of a dual tilt operation.

A load sensing controller is installed in a hydraulic circuit for implementing the drive control of the blade 3.

The load sensing control referred to here constitutes a control for changing the capacity (cc/rev) of the hydraulic pump, or more specifically the tilt-rotated position of a swash plate thereof, in such a way that the pressure differential ΔP (=Pp−PL) between the discharge pressure Pp of the hydraulic pump and the load pressure PL of the tilt cylinders 4, 5 is maintained at a set value ΔPLS.

The load sensing controller of this hydraulic circuit constitution comprises a variable capacity hydraulic pump, a directional flow control valve for controlling the flow of the flow of hydraulic oil supplied from the hydraulic pump to the tilt cylinders, and capacity control means for controlling the discharge amount (cc/rev) discharged from the hydraulic pump per turn of the pump and, serving as the capacity control means, a drive cylinder device for driving the swash plate of the hydraulic pump and a load sensing control valve (LS valve) for controlling the drive of the drive cylinder device. Here, the load sensing control valve comprises a pair of opposing drive parts, the discharge pressure Pp of the hydraulic pump and the load pressure PL of the hydraulic actuators are led to respective drive parts, and a spring of a spring force equivalent to the constant pressure differential ΔPLS is arranged in the drive part to which the load pressure PL is led.

In a hydraulic circuit constitution such as this, when hydraulic oil is supplied from the hydraulic pump, hydraulic oil is supplied to the tilt cylinders 4, 5 by way of the directional flow control valve, the tilt cylinders 4, 5 are driven, and the blade 3 is actuated. When the blade 3 is actuated, the load sensing control valve operates in accordance with the pressure differential ΔP between the discharge pressure Pp of the hydraulic pump and the load pressure (maximum load pressure) PL of the tilt cylinders 4, 5 and the drive cylinder device is driven. As a result, the capacity of the hydraulic pump (tilt-rotated position of the swash plate) is changed in such a way as to maintain the pressure differential ΔP at the constant pressure differential ΔPLS set by the spring.

Taking the opening area of the spool of the directional flow control valve as A and the resistance coefficient thereof as c, the discharge flow Q (1/min) of the hydraulic pump is expressed by equation (1) below:

$$Q=c\cdot A\cdot\sqrt{(\Delta P)} \quad (1)$$

Because the pressure differential ΔP is maintained by the load sensing control valve as a constant (ΔPLS), the hydraulic pump discharge flow Q is changed only by change in the opening area of the directional flow control valve spool A.

When the tilt operating lever is operated from the neutral position, the opening area of the directional flow control valve spool A increases in accordance with the extent of this operation and the pump flow Q increases in accordance with the increase of the opening area A. The pump flow Q at this time is determined by the extent of the operation of the tilt operating lever only and is unaffected by the magnitude of the tilt cylinder load. By the provision of a load sensing valve in this way the pump flow Q is changed in accordance with the wishes of the operator (in accordance with the operating position of the operating level) without fluctuation due to load and, accordingly, the fine control characteristics thereof, in other words the operability in the middle operating range, is improved.

Load sensing controllers are also installed in hydraulic excavators. Controllers installed in hydraulic excavators change the magnitude of the constant pressure differential ΔPLS established by the spring of the load sensing control valve in accordance with work type (work mode).

In addition, blades of both a standard specification and a large blade specification are used in bulldozers.

SUMMARY OF THE INVENTION

In bulldozers, unlike hydraulic excavators, because there is no particular necessity for change in accordance with the work mode, the pressure differential set value ΔPLS (LS pressure differential) formed as a constant of the pressure differential ΔP between the discharge pressure Pp of the hydraulic pump and the load pressure PL of the tilt cylinders 4, 5 is fixed as a constant value (LS set pressure) in accordance with the urging force of the spring provided in the load sensing control valve.

However, as is described above, the speed of the tilt operation of the blade 3 is different for tilt operations in which the pair of tilt cylinders 4, 5 are simultaneously driven and single tilt operations in which only one of the tilt cylinders is driven. Accordingly, a problem arises in that, when the operator operates the operating lever during the course of the work to perform a changeover from a dual tilt operation to a single operation (or the reverse changeover thereof), a sense of discomfort that has its origin in the difference in blade 3 operating speed is felt by the operator which, from the viewpoint of adjustments to the operation of the operating lever and so on, affects operability.

In addition, in the production of bulldozers of machine types of a standard blade specification and machine types of a large blade specification tilt cylinders of a size correspondent to the standard blade specification and tilt cylinders of a size correspondent to the large blade specification must be prepared, and these tilt cylinders of different size must be installed in the respective machine types. However, for the remaining component parts, a demand exists to as far as possible use common component parts.

However, when the LS set pressure ΔPLS is fixed to a constant value, because the discharge flow Q of the hydraulic pump is determined by the opening area of the directional flow control valve spool A as expressed by the abovementioned equation (1), for the supply of a flow to the tilt cylinders of a magnitude correspondent to the tilt cylinders a directional flow control valve must be prepared and installed in each specification and the opening area of the spool A must be set to a magnitude that corresponds to each specification.

The preparation of a control valve for each specification and the assembly of different directional flow control valves for each machine type in this way has an inherent and unavoidable problem of high production costs. This problem is evident not only in the manufacture of bulldozers but applies equally to the manufacture of other earthmoving machinery such as hydraulic excavators.

With the foregoing problems in view, it is an object of the present invention, without increasing the complexity of the device constitution and at low cost, to alleviate the sense of discomfort that has its origin in the difference in blade operating speeds when a changeover is made between a dual tilt operation and a single tilt operation and, accordingly, to improve operability, by producing the optimum pump flow for both dual tilt operations and single tilt operations.

A further object of the present invention is to markedly lower production costs by achieving commonality of use of directional flow control valves between specifications of different cylinder size.

A first invention comprises:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with when the single tilt operation is to be performed or the dual tilt operation is to be performed, for indicating alterations of the pressure differential set value; and pressure differential set value altering means for altering the pressure differential set value in accordance with indicated details of the indicating means.

A second invention comprises:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

operating means for implementing the changeover operation of the changeover means;

capacity control means for controlling a capacity of the hydraulic pump in such a way that a pressure differential between a discharge pressure of the hydraulic pump and a load pressure of the tilt hydraulic actuators is maintained at a set value; and pressure differential set value altering means, interlinked with the changeover operation by the changeover means, for altering the pressure differential set value.

A third invention comprises:

a blade tilt-operably attached to a vehicle main body;

a pair of tilt hydraulic actuators attached to left and right of the blade;

a variable capacity hydraulic pump for supplying hydraulic oil to the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with alterations of a size of the tilt hydraulic actuators, for indicating alterations of the pressure differential set value; and pressure differential set value altering means, for altering the pressure differential set value in accordance with the indicated details.

A fourth invention comprises:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value;

first indicating means, selected in accordance with when the single tilt operation is to be performed or the dual tilt operation is to be performed, for indicating alterations of the pressure differential set value;

second indicating means, selected in accordance with alterations of a size of the tilt hydraulic actuators, for indicating alterations of the pressure differential set value; and pressure differential set value altering means for altering the pressure differential set value in accordance with indicated details of the first and second indicating means.

A fifth invention comprises:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

operating means for implementing the changeover operation of the changeover means;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with alterations of a size of the tilt hydraulic actuators, for indicating alterations of the pressure differential set value; and pressure differential set value altering means, interlinked with the changeover operation by the changeover means in such a way that a single tilt operation or a dual tilt operation is implemented in accordance with the size indicated by the indicating means, for altering the pressure differential set value.

A sixth invention comprises:

a variable capacity hydraulic pump for supplying hydraulic oil to working hydraulic actuators of an earthmoving machine;

capacity control means for controlling a capacity of the hydraulic pump in such a way that a pressure differential between a discharge pressure of the hydraulic pump and a load pressure of the working hydraulic actuators is maintained at a set value;

first indicating means, selected in accordance with a work content, for indicating alterations of the pressure differential set value;

second indicating means, selected in accordance with alterations of a size of the working tilt hydraulic actuators, for indicating alterations of the pressure differential set value; and pressure differential set value altering means for altering the pressure differential set value in accordance with indicated details of the first and second indicating means.

In the first invention, as shown in FIG. 1 and FIG. 6A, where there is a wish to implement a dual tilt operation a switch 141*b* is selectively operated and, in accordance with this selection result, a load sensing set pressure changeover valve 39 opens wide. By virtue of this, a comparatively large pilot pressure is introduced into a first drive part 34 by way of a hydraulic passage 40.

In addition, where there is a wish to implement a single tilt operation a switch 141*a* is selectively operated and, in accordance with this selection result, the load sensing set pressure changeover valve 39 opens slightly. By virtue of this, a comparatively small pilot pressure is introduced into the first drive part 34 by way of the hydraulic passage 40.

As a result, when a dual tilt operation is implemented, the value of the pressure differential ΔPLS decreases and a comparatively small flow is supplied from the hydraulic pump 7 to left and right tilt cylinders 4, 5. Accordingly, the extension/retraction speed of the left and right tilt cylinders 4, 5 decreases.

On the other hand, when a single tilt operation is implemented, the value of the pressure differential ΔPLS increases and a comparatively large flow is supplied from the hydraulic pump 7 to the left tilt cylinder 4. Accordingly, the extension/retraction speed of the left tilt cylinder 4 increases.

As a result of the increase in the extension/retraction speed of the left tilt cylinder 4 when a single tilt operation is implemented at an original low operating speed of the blade 3 (operating speed that is half that of the dual tilt operation) and the decrease in the extension/retraction speed of each of the left and right tilt cylinders 4, 5 when a dual tilt operation is implemented at an original high operating speed of the blade 3 (operating speed that is twice that of the dual tilt operation) in this way, the tilt operating speed of the blade 3 in dual tilt operations and the tilt operating speed of the blade 3 in single tilt operations can be formed of equal magnitude. By virtue of this, when a changeover from a dual tilt operation to a single tilt operation (or when the reverse changeover thereto is made) is implemented the operating speed of the blade 3 is unaltered and the discomfort associated with alteration of the operating speed when a changeover is implemented is alleviated. Accordingly, the operability throughout the working of the bulldozer is markedly improved.

In the second invention, as shown in FIG. 3, electrical signals that differ in magnitude depending on whether neither of switches 23*a*, 23*b* are pushed (when single tilt operation is implemented) or whether the switch 23*b* is pushed (when dual tilt operation is implemented) are generated by a controller 42, the electrical signals of different magnitude for single tilt operations and dual tilt operations are sent from the controller 42 to the load sensing set pressure changeover valve 39, and a load sensing set pressure changeover valve 39 opening area of different magnitude for single tilt operations and dual tilt operations is produced.

That is to say, where there is a wish to implement a dual tilt operation, an operation that involves pushing of the dual tilt switch 23*b* of the operating lever 23 is implemented. Interlinked with this operation, the load sensing set pressure changeover valve 39 opens wide. By virtue of this, a comparatively large pilot pressure is introduced into the first drive part 34 by way of the hydraulic passage 40.

In addition, where there is a wish to implement a single tilt operation, the operation (operation OFF) that is implemented involves neither the pushing of the pitch dump/pitch back switch 23*a* or the dual tilt switch 23*b* of the operating lever 23. Interlinked with this operation, the load sensing set pressure changeover valve 39 opens slightly. By virtue of this, a comparatively small pilot pressure is introduced into the first drive part 34 by way of the hydraulic passage 40.

As a result, when a dual tilt operation is implemented, the value of the pressure differential set value ΔPLS decreases and a comparatively small flow is supplied to the left and right tilt cylinders 4, 5 from the hydraulic pump 7. Accordingly, the extension/retraction speed of the left and right tilt cylinders 4, 5 decreases.

On the other hand, when a single tilt operation is implemented, the value of the pressure differential set value ΔPLS increases and a comparatively large flow is supplied from the hydraulic pump 7 to the left tilt cylinder 4. Accordingly, the extension/retraction speed of the left tilt cylinder 4 increases. By virtue of this, the tilt operating speed of the blade 3 in dual tilt operations and the tilt operating speed of the blade 3 in single tilt operations can be formed to be of the same magnitude and, in the same way as the first invention, when a changeover from a dual tilt operation to a single tilt operation is implemented (or when the reverse changeover thereof is implemented), the operating speed of the blade 3 is unaltered and discomfort to the operator is alleviated. Accordingly the operability throughout the working of the bulldozer is markedly improved.

Furthermore, based on this second invention, because the control of the tilt operating speed of the blade is interlinked with the switches 23*a*, 23*b* provided in the operating lever 23 and is automatically implemented, the implementation of an indicating operations using an indicating device 41 is unnecessary which, accordingly, lessens the load on the operator and eliminates the possibility of indicating operation errors and indicating operation negligence.

The constitution of the third invention comprises, specifically, an indicating device 241 shown in FIG. 6B replacing the indicating device 41 of the hydraulic circuit of FIG. 1.

That is to say, a switch 241*b* is selectively operated when the cylinder size is small and, in accordance with this selection result, the load sensing set pressure changeover valve 39 opens wide. By virtue of this, a comparatively large pilot pressure is introduced into the first drive part 34 by way of the hydraulic passage 40.

In addition, the switch 241*a* is selectively operated when the cylinder size is large and, in accordance with this selection result, the load sensing set pressure changeover valve 39 opens slightly. By virtue of this, a comparatively small pilot pressure is introduced into the first drive part 34 by way of the hydraulic passage 40.

As a result, when the cylinder size is small, the value of the differential set pressure ΔPLS decreases and, based on the abovementioned equation (1) ($Q=c\cdot A\cdot\sqrt{(\Delta P)}$), a comparatively small flow Q is supplied from the hydraulic pump 7 to the left and right tilt cylinders 4, 5. Accordingly, the left and right tilt cylinders 4, 5 are operated at an extension/retraction speed that is suitable for a small size cylinder.

On the other hand, when the cylinder size is large, the value of the differential set pressure ΔPLS increases and a comparatively small flow Q is supplied from the hydraulic pump 7 to the left and right tilt cylinders 4, 5. Accordingly, the left and right tilt cylinders 4, 5 are operated at an extension/retraction speed that is suitable for a large size cylinder.

Based on this third invention, when bulldozers of a machine type of a standard blade specification and a machine type of large blade specification are produced, directional flow control valves 9, 16 are common to both specifications and, by the simple implementation of an indicating operation using the indicating device 241, a flow correspondent to the cylinder size of each specification can be supplied to the tilt cylinders.

Accordingly, production costs associated with the production of bulldozers of various machine types can be suppressed. In addition, across differing specifications, the number of manufacturing steps thereof can be reduced.

In the fourth invention, as shown in FIG. 5, where there is a wish to implement a dual tilt operation a switch 141*b* is selectively operated. In addition, where there is a wish to implement a single tilt operation a switch 141*a* is selectively operated.

The switch 241*b* is selectively operated when the cylinder size of the tilt cylinders 4, 5 is small. The switch 241*a* is selectively operated when the cylinder size of the tilt cylinders 4, 5 is large.

Accordingly, based on this fourth invention, the effects of the first invention and the third invention are combined.

The constitution of the fifth invention comprises, specifically, as shown in FIG. 4, the indicating device 241 shown in FIG. 6B replacing the indicating device 41.

That is to say, where there is a wish to implement a dual tilt operation, an operation that involves the pushing of the dual tilt switch 23*b* of the operating lever 23 is implemented, and these operation details are input as electrical signals to the controller 42. In addition, where there is a wish to implement a single tilt operation, an operation (operation OFF) that involves neither the pushing of the pitch dump/pitch back switch 23*a* or the dual tilt switch 23*b* of the operating lever 23 is implemented, and these operation details are input as electrical signals to the controller 42.

The switch 241*b* is operated when the cylinder size of the tilt cylinders 4, 5 is small. In addition, the switch 241*a* is operated when the cylinder size of the tilt cylinders 4, 5 is large.

Accordingly, based on this fifth invention, the effect of the second invention and the third invention is combined.

The constitution of the sixth invention comprises, specifically, as shown in FIG. 7, an indicating device 341 replacing the indicating device 41 shown in FIG. 5.

Where there is a wish to implement a "work 2" a switch 341*b* is selectively operated. In addition, where there is a wish to implement a "work 1" a switch 341*a* is selectively operated.

The switch 241*b* is selectively operated when the cylinder size of the tilt cylinders is small. The switch 241*a* is selectively operated when the cylinder size of the tilt cylinders is large.

Accordingly, based on the sixth invention, the magnitude of the pressure differential set value can be changed in accordance with the work mode which facilitates an improvement in work efficiency, the capacity for changes in cylinder size to be dealt with without replacing the directional flow control valves, and the suppression of production costs and device amendment and improvement costs.

DETAILED DESCRIPTION OF THE PREFERRED EMBODIMENTS

A description of the embodiments of the oil-pressure controlling device for an earthmoving machine pertaining to the present invention is given below with reference to the diagrams.

Figure 1:
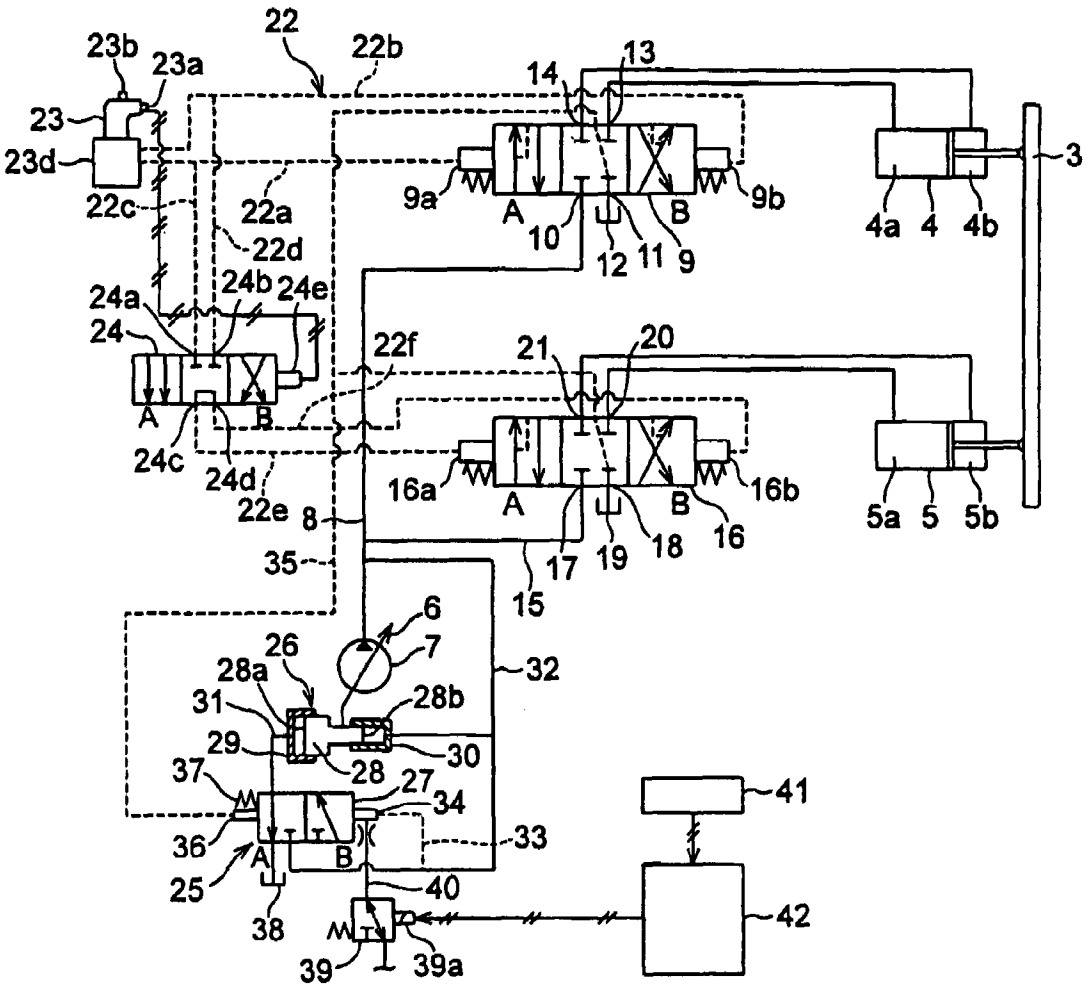
FIG. 1 is a hydraulic circuit diagram of a bulldozer oil-pressure controlling device pertaining to a first embodiment of the present invention.
Figure 2:
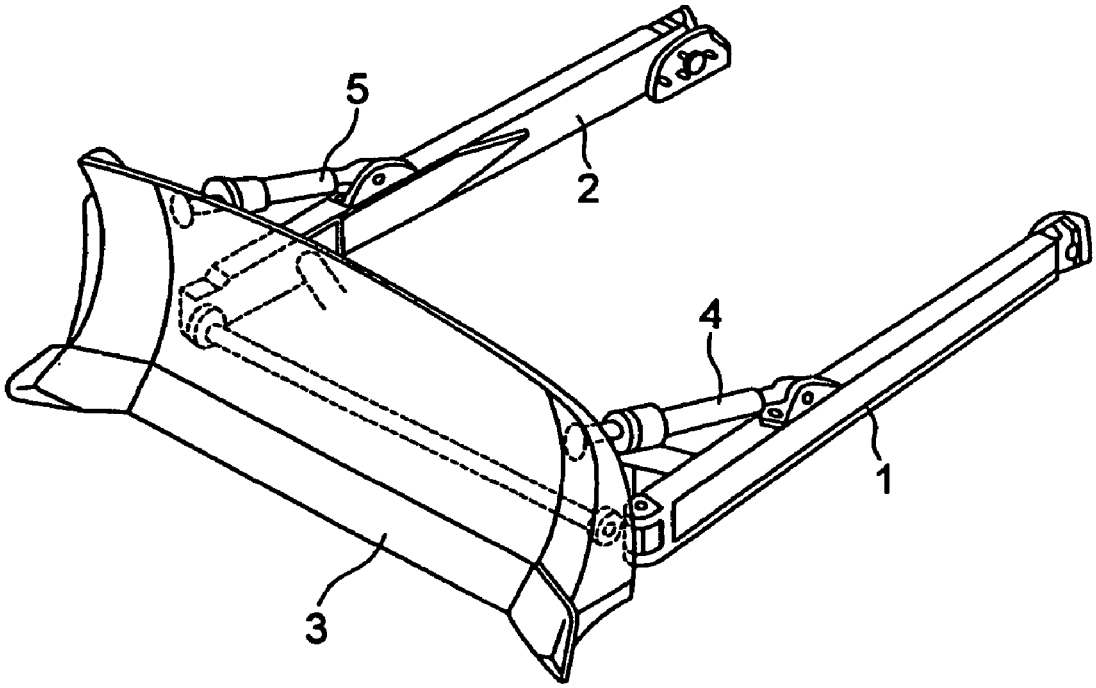
FIG. 2 is a perspective view of the peripheral parts of the bulldozer blade of this embodiment.

FIG. 1 is a diagram of a first embodiment of the present invention. In FIG. 1, an oil-pressure controlling device for a bulldozer is illustrated using a hydraulic circuit diagram. FIG. 2 is a perspective view of the constitution of the peripheral parts of the bulldozer blade.

As shown in FIG. 2, a blade 3 is provided in the front part of the vehicle main body not shown in the diagram. That is to say, in the left and right outer side of a truck frame not shown in the diagram, one end of a left and right pair of straight frames 1, 2 are supported using trunnions as a fulcrum. The front ends of the straight frames 1, 2 are pivotally-supported at positions to the left and right respectively of the rear surface of the blade 3.

A pair of left and right tilt cylinders (tilt hydraulic actuators) 4, 5 that tilt the blade 3 to the left and right are provided between the blade 3 and the straight frames 1, 2. Rods of the tilt cylinders 4, 5 connect to the left and right of the rear surface of the blade 3, and the cylinder main body of the tilt cylinders 4, 5 connects to the straight frames 1, 2. It should be noted that, although omitted from FIG. 2, a pair of left and right lift cylinders for raising and lowering the blade 3 are provided.

As shown in FIG. 1, hydraulic oil is supplied from a variable capacity hydraulic pump 7 to each of the left tilt cylinder 4 and the right tilt cylinder 5. The capacity (cc/rev) of the variable capacity type hydraulic pump 7 is changed by the changing of the tilt-rotated position of a swash plate 6.

A discharge port of the hydraulic pump 7 is linked to a discharge hydraulic passage 8. The discharge hydraulic passage 8 is linked to a pump port 10 of a directional flow control valve 9 of the left tilt cylinder 4. A tank port 11 of the directional flow control valve 9 is linked to a tank 12.

Cylinder ports 13, 14 of the directional flow control valve 9 are linked to a bottom-side oil chamber 4*a* and a head-side oil chamber 4*b* respectively of the left tilt cylinder 4.

The directional flow control valve 9 has a valve position A at which the pump port 10 is linked to the cylinder port 14 and the tank port 11 is linked to a cylinder port 13, a neutral position, and a valve position B at which the pump port 10 is linked to the cylinder port 13 and the tank port 11 is linked to the cylinder port 14.

Pilot ports 9*a*, 9*b* are provided in the directional flow control valve 9. When pilot hydraulic oil is supplied to the pilot port 9*a* the directional flow control valve 9 is actuated to the valve position A side. In addition, when the pilot hydraulic oil is supplied to the pilot port 9*b* the directional flow control valve 9 is actuated to the valve position B side.

On the other hand, the discharge hydraulic passage 8 branches into a branched hydraulic passage 15, and the branched hydraulic passage 15 is linked to a pump port 17 of a directional flow control valve 16 of the right tilt cylinder 5. A tank port 18 of the directional flow control valve 16 is linked to a tank 19.

Cylinder ports 20, 21 of the directional flow control valve 16 are linked to a bottom-side oil chamber 5*a* and a head-side oil chamber 5*b* respectively of the right tilt cylinder 5.

The directional flow control valve 16 has a valve position A at which the pump port 17 is linked to the cylinder port 21 and the tank port 18 is linked to the cylinder port 20, a neutral position, and a valve position B at which the pump port 17 is linked to the cylinder port 20 and the tank port 18 is linked to the cylinder port 21.

Pilot ports 16*a*, 16*b* are provided in the directional flow control valve 16. When pilot hydraulic oil is supplied to the pilot port 16*a* the directional flow control valve 16 is actuated to the valve position A side. In addition, when the pilot hydraulic oil is supplied to the pilot port 16*b* the directional flow control valve 9 is actuated to the valve position B side.

Pilot hydraulic oil is supplied to pilot ports 9*a*, 9*b*, 16*a*, 16*b* of the directional flow control valves 9, 16 by way of a pilot pressure signal circuit 22 for which a pilot pump not shown in the diagram is used as a drive source.

An operating lever 23 tilt-operable to the left and right directions is provided in the driver seat of the bulldozer. A pilot valve 23*d* is attached to the operating lever 23, and the pilot valve 23*d* is actuated in accordance with the operation of the operating lever 23. A pitch dump/pitch back switch 23*a* and dual tilt switch 23*b* are provided in the operating lever 23.

In addition, together with the interposing of a pilot changeover valve 24, pilot hydraulic passages 22*a* to 22*f* are arranged along the pilot signal circuit 22.

A pilot hydraulic oil is supplied from the pilot pump to the inlet port of the pilot valve 23*d* provided in the operating lever 23. An output port of the operating lever 23 links to either the pilot hydraulic passage 22*a* or 22*b* in accordance with the direction in which the operating lever 23 is operated. The pilot hydraulic passage 22*a* is linked to the pilot port 9*a* of the directional flow control valve 9, and the pilot hydraulic passage 22*b* is linked to the pilot port 9*b* of the directional flow control valve 9. The pilot hydraulic passage 22*a* is linked to the pilot hydraulic passage 22*c*, and the pilot hydraulic passage 22*b* is linked to the pilot hydraulic passage 22*d*. The pilot hydraulic passages 22*c*, 22*d* are linked to the inlet ports 24*a*, 24*b* respectively of the pilot changeover valve 24.

The outlet ports 24*c*, 24*d* of the pilot changeover valve 24 are linked to the pilot ports 16*a*, 16*b* of the directional flow control valve 16 by way of the pilot hydraulic passages 22*e*, 22*f*.

The pilot changeover valve 24 has a valve position A at which the inlet port 24*a* is linked to the output port 24*c* and the inlet port 24*b* is linked to the outlet port 24*d*, a neutral position, and a valve position B at which the inlet port 24*a* is linked to the outlet port 24*d* and the inlet port 24*b* is linked to the output port 24*c*. An electromagnetic solenoid 24*e* is provided in the pilot changeover valve 24, and the pilot changeover valve 24 is actuated and the valve position thereof changed over in response to electrical signals sent to the electromagnetic solenoid 24*e*. Electrical signals are imparted to the electromagnetic solenoid 24*e* of the pilot changeover valve 24 in accordance with the operational state of the switches 23*a*, 23*b*.

As is described later, in accordance with the direction in which the operating lever 23 is operated and the operational state of the switches 23*a*, 23*b*, changeovers are implemented between a pitch dump operation of the blade 3 by the drive of both tilt cylinders 4, 5 (forward tilt operation), a pitch back operation of the blade 3 by the drive of both tilt cylinders 4, 5 (backward tilt operation), a single tilt operation of the blade 3 by the drive of the left tilt cylinder 4 only, and a dual tilt operation of the blade 3 by the drive of both tilt cylinders 4, 5.

A load sensing control device is installed in the hydraulic circuit shown in FIG. 1.

That is to say, the tilt-rotated position of the swash plate 6 of the hydraulic pump 7 is controlled by means of a capacity controller 25. The capacity controller 25 comprises a drive cylinder device (regulator) 26 that, in accordance with the position of a piston 28, changes the tilt-rotated position of the swash plate 6 of the hydraulic pump 7 to change the capacity (cc/rev), and a load sensing control valve 27 that controls the drive of the piston 28 of the drive cylinder device 26 and controls the tilt-rotated position of the swash plate 6 of the hydraulic pump 7 in such a way that the pressure differential $\Delta P$ between the discharge pressure Pp of the hydraulic pump 7 and the load pressure PL of the tilt cylinders 4, 5 is maintained to the set value $\Delta PLS$.

The drive cylinder device 26 comprises a piston 28 that comprises, in both end parts, a large diameter pressure-receiving part 28*a* and small diameter pressure-receiving part 28*b*, and a first cylinder 29 and second cylinder 30 in which each of the pressure-receiving parts 28*a*, 28*b* of the piston 28 are inserted. The first cylinder 29 is connected to the load sensing control valve 27 by way of a hydraulic passage 31. The second cylinder 30 is connected to the discharge hydraulic passage 8 of the hydraulic pump 7 by way of a hydraulic passage 32. The piston 28 is connected to the swash plate 6 of the hydraulic pump 7. When the piston 28 is driven to the left direction in the diagram the tilt-rotated position of the swash plate 6 of the hydraulic pump 7 enlarges and the capacity is increased. In addition, when the piston 26 is driven to the right direction in the diagram, the tilt-rotated position 6 of the swash plate 6 of the hydraulic pump 7 is lower and the capacity is reduced.

The load sensing control valve 27 comprises a first drive part (pilot port) 34 to which the discharge pressure Pp of the hydraulic pump 7 is introduced by way of the hydraulic passage 32 and a pilot hydraulic passage 33 that is linked therewith and a second drive part (pilot port) 36 to which the load pressure PL of the tilt cylinders 4, 5 (maximum load pressure of the two tilt cylinders 4, 5) is introduced by way of the pilot hydraulic passage 35 and, adjacently arranged in the side in which the second drive part 36 is provided, a spring 37 of a spring force equivalent to the set pressure differential ΔPLS of the pressure differential ΔP between the pressure differential Pp of the hydraulic pump 7 and the load pressure PL of the tilt cylinders 4, 5.

When the load sensing control valve 27 is in the A position (position not shown in the diagram), the cylinder chamber of the first cylinder 29 is linked to the tank 38 by way of the hydraulic passage 31 and the pressure in the cylinder chamber of the first cylinder 29 equalizes with the tank pressure. In addition, when the load sensing control valve 27 is in the B position, the cylinder chamber of the first cylinder 29 is linked to the discharge hydraulic passage 8 of the hydraulic pump 7 by way of the hydraulic passages 31, 32 and the pressure in the cylinder chamber of the first cylinder 29 equalizes with the discharge pressure Pp of the hydraulic pump 7. In addition, when the load sensing control valve 27 is in a middle position between the A position and the B position, the cylinder chamber of the first cylinder 29 is linked to both the tank 38 and the discharge hydraulic passage 8 in a linked state that is proportionate to said position, and the cylinder chamber of the first cylinder 29 equalizes with a pressure that is between that of the tank pressure and the discharge pressure Pp of the hydraulic pump 7.

The magnitude of the pressure differential setting value ΔPLS is changed by a load sensing set pressure changeover valve 39. The inlet port of the load sensing set pressure changeover valve 39 is linked with a pilot pump not shown in the diagram. An input port of the load sensing set pressure changeover valve 39 is linked to the first drive part 34 of the load sensing control valve 27 by way of the pilot hydraulic passage 40. The load sensing set pressure changeover valve 39 has an electromagnetic solenoid 39*a*, and the valve position changes in response to electrical signals sent to the electromagnetic solenoid 39 whereupon the opening area thereof changes and the magnitude of the pilot pressure added to the first drive part 34 of the load sensing control valve 27 by way of the changeover valve 39 and the pilot hydraulic passage 40 changes. When the magnitude of the pilot pressure added to the first drive part 34 changes the magnitude of the pressure differential set value ΔPLS changes. Because the first drive part 34 is provided opposing the spring 37 (set value pressure differential ΔPLS), the magnitude of the differential set value ΔPLS is determined by the difference in value between the urging force of the spring 37 (spring force) and the pilot pressure introduced to the first drive part 34 by way of the pilot hydraulic passage 40. When the pilot pressure added to the first drive part 34 increases the pressure differential set value ΔPLS decreases and, when the pilot pressure added to the first drive part 34 decreases, the pressure differential set value ΔPLS increases.

The electrical signals are sent to the electromagnetic solenoid valve 39*a* of the load sensing set pressure changeover valve 39 in accordance with details as indicated using the indicating device 41.

Figure 6A:
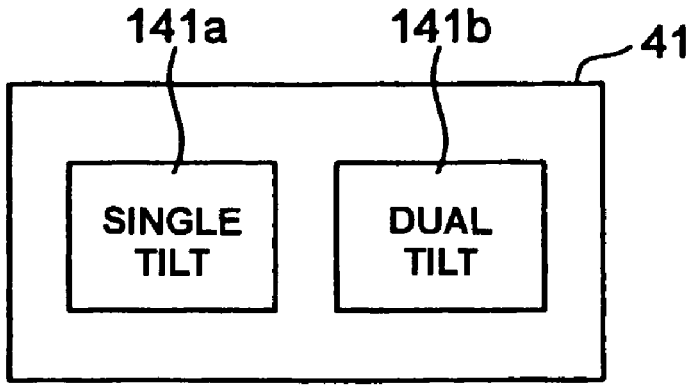
FIGS. 6A and 6B are diagrams illustrating indicating devices.

That is to say, the indicating device 41 is provided in the driver seat. The indicating device 41, which as shown in FIG. 6A comprises a switch 141*a* that is selected when a "single tilt" operation is to be performed and a switch 141*b* that is selected when a "dual tilt" operation is to be performed, is selectively operated by the operator. The indicating device 41 is connected to a controller 42 by way of an electrical signal line. The controller 42 is connected to the electromagnetic solenoid valve 39*a* of the load sensing set pressure changeover valve 39 by way of an electrical signal line.

When either of the switches 141*a*, 141*b* of the indicating device 41 is selectively operated electrical signals are generated by the controller 42 in accordance with the selected details thereof, and the electrical signals produced in accordance with the selected details thereof are sent from the controller 42 to the electromagnetic solenoid valve 39*a* of the load sensing set pressure changeover valve 39. The valve position of the load sensing set pressure changeover valve 39 changes over in accordance with the details selectively indicated using the indicating device 41 and, as a result, the opening area thereof changes and pilot pressure of a magnitude in accordance with the selectively indicated details is added to the first drive part 34 of the load sensing valve 27.

A description is given below of the operation of the hydraulic circuit described above.

Where there is a wish to implement a pitch dump operation the operator, while pushing the pitch dump/pitch back switch 23*a* of the operating lever 23, implements an operation to tilt the operating lever 23 to the "right direction".

The pilot pressure discharged from the output port of the pilot valve 23*d* when the operating lever 23 is pushed to the right direction is supplied to the pilot hydraulic passage 22*b* and, by way of the pilot hydraulic passage 22*b*, this pilot pressure acts on the pilot port 9*b* of the directional flow control valve 9.

In addition, the pilot changeover valve 24 is changed over to the A position by the pushing of the switch 23*a*. Accordingly, by way of the pilot hydraulic passage 22*b*, pilot hydraulic passage 22*d*, pilot changeover valve 24 and the pilot port 22*f*, the pilot pressure discharged from the output port of the pilot valve 23*d* acts on the pilot port 16*b* of the directional flow control valve 16.

By virtue of this, the directional flow control valve 9 is changed over to the B position and the directional flow control valve 16 is also changed over to the B position. As a result, the hydraulic oil discharged from the hydraulic pump 7 passes though the pump port 10 and cylinder port 13 of the directional flow control valve 9 to be supplied to the bottom-side oil chamber 4*a* of the left tilt cylinder 4 actuating the left tilt cylinder 4 in the direction of extension. Returning hydraulic oil from the head-side hydraulic chamber 4*b* of the left tilt cylinder 4 passes through the cylinder port 14 and tank port 11 of the directional flow control valve 9 to be recovered in the tank 12.

Simultaneously therewith, the hydraulic oil discharged from the hydraulic pump 7 passes though the pump port 17 and the cylinder port 20 of the directional flow control valve 16 to be supplied to the bottom-side oil chamber 5*a* of the right tilt cylinder 5 actuating actuate the right tilt cylinder 5 in the direction of extension. Returning hydraulic oil from the head-side oil chamber 5*b* of the right tilt cylinder 5 passes though the cylinder port 21 and the tank port 18 of the directional flow control valve 16 to be collected in a tank 19. In this way, the left and right tilt cylinders 4, 5 are extended simultaneously, and at equivalent speed, to effect the pitch dump (forward tilt) operation of the blade 3.

Where there is a wish to implement a pitch back operation the operator, while pushing the pitch dump/pitch back switch 23*a* of the operating lever 23, implements an operation to tilt the operating lever 23 to the "left direction".

The pilot pressure discharged from the output port of the pilot valve 23*d* when the operating lever 23 is pushed to the left direction is supplied to the pilot hydraulic passage 22*a* and, by way of the pilot hydraulic passage 22*a*, this pilot pressure acts on the pilot port 9*a* of the directional flow control valve 9.

In addition, the pilot changeover valve 24 is changed over to the A position by the pushing of the switch 23*a*. Accordingly, by way of the pilot hydraulic passage 22*a*, pilot hydraulic passage 22*c*, pilot changeover valve 24 and the pilot port 22*e*, the pilot pressure discharged from the output port of the pilot valve 23*d* acts on the pilot port 16*a* of the directional flow control valve 16.

By virtue of this, the directional flow control valve 9 is changed over to the A position and the directional flow control valve 16 is also changed over to the A position.

As a result, the hydraulic oil discharged from the hydraulic pump 7 passes though the pump port 10 and cylinder port 14 of the directional flow control valve 9 to be supplied to the head-side oil chamber 4*b* of the left tilt cylinder 4 actuating the left tilt cylinder 4 in the direction of retraction. Returning hydraulic oil from the bottom-side hydraulic chamber 4*a* of the left tilt cylinder 4 passes through the cylinder port 13 and tank port 11 of the directional flow control valve 9 to be recovered in the tank 12.

Simultaneously therewith, the hydraulic oil discharged from the hydraulic pump 7 passes though the pump port 17 and the cylinder port 21 of the directional flow control valve 16 to be supplied to the head-side oil chamber 5*b* of the right tilt cylinder 5 actuating the right tilt cylinder 5 in the direction of retraction. Returning hydraulic oil from the bottom-side oil chamber 5*a* of the right tilt cylinder 5 passes though the cylinder port 20 and the tank port 18 of the directional flow control valve 16 to be recovered in the tank 19. In this way, the left and right tilt cylinders 4, 5 are retracted simultaneously, and at the same speed, to effect the pitch back (backward tilt) operation of the blade 3.

Where there is a wish to implement a right dual tilt operation the operator, while pushing the dual tilt switch 23*b* of the operating lever 23, implements an operation to tilt the operating lever 23 to the "right direction".

The pilot pressure discharged from the output port of the pilot valve 23*d* when the operating lever 23 is pushed to the right direction is supplied to the pilot hydraulic passage 22*b* and, by way of the pilot hydraulic passage 22*b*, this pilot pressure acts on the pilot port 9*b* of the directional flow control valve 9.

In addition, the pilot changeover valve 24 is changed over to the B position by the pushing of the switch 23*b*. Accordingly, by way of the pilot hydraulic passage 22*b*, pilot hydraulic passage 22*d*, pilot changeover valve 24 and the pilot port 22*e*, the pilot pressure discharged from the output port of the pilot valve 23*d* acts on the pilot port 16*a* of the directional flow control valve 16.

By virtue of this, the directional flow control valve 9 is changed over to the B position and the directional flow control valve 16 is changed over to the A position.

As a result, the hydraulic oil discharged from the hydraulic pump 7 passes though the pump port 10 and cylinder port 13 of the directional flow control valve 9 to be supplied to the bottom-side oil chamber 4*a* of the left tilt cylinder 4 actuating the left tilt cylinder 4 in the direction of extension. Returning hydraulic oil from the head-side hydraulic chamber 4*b* of the left tilt cylinder 4 passes through the cylinder port 14 and tank port 11 of the directional flow control valve 9 to be recovered in the tank 12.

Simultaneously therewith, the hydraulic oil discharged from the hydraulic pump 7 passes though the pump port 17 and the cylinder port 21 of the directional flow control valve 16 to be supplied to the head-side oil chamber 5*b* of the right tilt cylinder 5 actuating the right tilt cylinder 5 in the direction of retraction. Returning hydraulic oil from the bottom-side oil chamber 5*a* of the right tilt cylinder 5 passes though the cylinder port 20 and the tank port 18 of the directional flow control valve 16 to be recovered in the tank 19.

In this way, the extending operation of the left tilt cylinder 4 and the retracting operation of the right tilt cylinder 5 is implemented simultaneously, at high speed (about twice the speed of the single tilt operation), to effect the right dual tilt operation of the blade 3.

Where there is a wish to implement a left dual tilt operation the operator, while pushing the dual tilt switch 23*b* of the operating lever 23, implements an operation to tilt the operating lever 23 to the "left direction".

The pilot pressure discharged from the output port of the pilot valve 23*d* when the operating lever 23 is pushed to the left direction is supplied to the pilot hydraulic passage 22*a* and, by way of the pilot hydraulic passage 22*a*, this pilot pressure acts on the pilot port 9*a* of the directional flow control valve 9.

In addition, the pilot changeover valve 24 is changed over to the B position by the pushing of the switch 23*b*. Accordingly, by way of the pilot hydraulic passage 22*a*, pilot hydraulic passage 22*c*, pilot changeover valve 24 and the pilot port 22*f*, the pilot pressure discharged from the output port of the pilot valve 23*d* acts on the pilot port 16*b* of the directional flow control valve 16.

By virtue of this, the directional flow control valve 9 is changed over to the A position and the directional flow control valve 16 is changed over to the B position.

As a result, the hydraulic oil discharged from the hydraulic pump 7 passes though the pump port 10 and cylinder port 14 of the directional flow control valve 9 to be supplied to the head-side oil chamber 4*b* of the left tilt cylinder 4 actuating the left tilt cylinder 4 in the direction of retraction. Returning hydraulic oil from the bottom-side hydraulic chamber 4*a* of the left tilt cylinder 4 passes through the cylinder port 13 and tank port 11 of the directional flow control valve 9 to be recovered in the tank 12.

Simultaneously therewith, the hydraulic oil discharged from the hydraulic pump 7 passes though the pump port 17 and the cylinder port 20 of the directional flow control valve 16 to be supplied to the bottom-side oil chamber 5*a* of the right tilt cylinder 5 actuating the right tilt cylinder 5 in the direction of extension. Returning hydraulic oil from the head-side oil chamber 5*b* of the right tilt cylinder 5 passes though the cylinder port 21 and the tank port 18 of the directional flow control valve 16 to be recovered in a tank 19.

In this way, the retracting operation of the left tilt cylinder 4 and the extending operation of the right tilt cylinder 5 is implemented simultaneously, at high speed (about twice the speed of the single tilt operation), to effect the left dual tilt operation of the blade 3.

Where there is a wish to implement a right single tilt operation the operator, without pushing either the pitch dump/pitch back switch 23*a* or dual tilt switch 23*b* of the operating lever 23, implements an operation to tilt the operating lever 23 to the "right direction".

The pilot pressure discharged from the output port of the pilot valve 23*d* when the operating lever 23 is pushed to the right direction is supplied to the pilot hydraulic passage 22*b* and, by way of the pilot hydraulic passage 22*b*, this pilot pressure acts on the pilot port 9*b* of the directional flow control valve 9.

In addition, because neither of the switches 23*a*, 23*b* are pushed, the pilot changeover valve 24 is maintained in the neutral position. Accordingly, there is no pilot pressure supplied to the pilot ports 16*a*, 16*b* of the directional flow control valve 16.

By virtue of this, the directional flow control valve 9 is changed over to the B position and the directional flow control valve 16 is maintained in the neutral position.

As a result, the hydraulic oil discharged from the hydraulic pump 7 passes though the pump port 10 and cylinder port 13 of the directional flow control valve 9 to be supplied to the bottom-side oil chamber 4*a* of the left tilt cylinder 4 actuating the left tilt cylinder 4 in the direction of extension. Returning hydraulic oil from the head-side hydraulic chamber 4*b* of the left tilt cylinder 4 passes through the cylinder port 14 and tank port 11 of the directional flow control valve 9 to be recovered in the tank 12.

On the other hand, because the directional flow control valve 16 is in the neutral position no hydraulic oil is supplied to the right tilt cylinder 5 and the actuation of the right tilt cylinder 5 is stopped.

In a state in which only the right tilt cylinder 5 is stopped in this way, the extending operation of only the left tilt cylinder 4 is implemented, at normal speed (low speed), to effect the right single tilt operation of the blade 3.

Where there is a wish to implement a left single tilt operation the operator, without pushing either the pitch dump/pitch back switch 23*a* or dual tilt switch 23*b* of the operating lever 23, implements an operation to tilt the operating lever 23 to the "left direction".

The pilot pressure discharged from the output port of the pilot valve 23*d* when the operating lever 23 is pushed to the left direction is supplied to the pilot hydraulic passage 22*a* and, by way of the pilot hydraulic passage 22*a*, this pressure acts on the pilot port 9*a* of the directional flow control valve 9.

In addition, because neither of the switches 23*a*, 23*b* are pushed, the pilot changeover valve 24 is maintained in the neutral position. Accordingly, no pilot pressure is supplied to the pilot ports 16*a*, 16*b* of the directional flow control valve 16.

By virtue of this, the directional flow control valve 9 is changed over to the A position and the directional flow control valve 16 is maintained in the neutral position.

As a result, the hydraulic oil discharged from the hydraulic pump 7 passes though the pump port 10 and cylinder port 14 of the directional flow control valve 9 to be supplied to the head-side oil chamber 4*b* of the left tilt cylinder 4 actuating the left tilt cylinder 4 in the direction of retraction. Returning hydraulic oil from the bottom-side hydraulic chamber 4*a* of the left tilt cylinder 4 passes through the cylinder port 13 and tank port 11 of the directional flow control valve 9 to be recovered in the tank 12.

On the other hand, because the directional flow control valve 16 is in the neutral position there is no supply of hydraulic oil to the right tilt cylinder 5 and the actuation of the right tilt cylinder 5 is halted.

In a state in which only the right tilt cylinder 5 is stopped in this way, the retracting operation of only the left tilt cylinder 4 is implemented, at normal speed (low speed), to effect the left single tilt operation of the blade 3.

Incidentally, an unload valve (not shown in the diagrams) is provided within a hydraulic passage that connects the discharge hydraulic passage 8 of the hydraulic pump 7 and the load pressure introducing hydraulic passage 35 of the tilt cylinders 4, 5.

When the directional flow control valves 9, 16 are in the neutral position, the discharge pressure of the hydraulic pump 7 when the swash plate 6 of the hydraulic pump 7 is in the minimum tilt-rotated position (minimum discharge pressure) is set by the abovementioned unload valve in such a way as to equalize with the regulated pressure of the unload valve.

The minimum discharge pressure of the hydraulic pump 7 is led to the second cylinder 30 of the drive cylinder device 26, and is led to the first drive part 34 of the load sensing control valve 27. Accordingly, resisting the urging force of the spring 37, the load sensing control valve 27 is driven to the B position. By virtue of this, the minimum discharge pressure is led by way of the hydraulic passage 31 to the first cylinder 29 of the drive cylinder device 26, the piston 28 is driven in the direction to the right in the diagram due to the difference in surface area between the pressure-receiving parts 28*a*, 28*b*, and the minimum tilt-rotating position of the swash plate 6 of the hydraulic pump 7 is maintained.

From this state, the directional flow control valves 9, 16 are changed over from the neutral position to either the A position or the B position. When this happens, due to the hydraulic oil discharged from the hydraulic pump 7, the tilt cylinders 4, 5 are driven as described above. When the tilt cylinders 4, 5 are driven a load pressure PL is generated in the tilt cylinders 4, 5. The load pressure PL is introduced into the second drive part 36 of the load sensing control valve 27 by way of the hydraulic passage 35. By virtue of this, the load sensing control valve 27 shifts to the A position. When the load sensing control valve 27 shifts to the A position side the cylinder chamber of the first cylinder 29 is linked to a tank 38 whereupon the piston 28 is driven to the left direction in the diagram, the tilt-rotated angle of the swash plate 6 of the hydraulic pump 6 is increased, and the capacity of the hydraulic pump 7 is increased. As a result of the increase in the capacity of the hydraulic pump 7 the flow supplied to the discharge hydraulic passage 8 increases. The increase in the discharge flow continues until a balance is reached between the pressure differential $\Delta P$ between the load pressure PL of the tilt cylinders 4, 5 and the discharge pressure Pp of the hydraulic pump 7 and the pressure differential set value $\Delta PLS$ determined by the difference in value between the pilot pressure introduced into the first drive part 34 by way of the pilot hydraulic passage 40 and the urging force of the spring 37. To put this another way, the capacity of the hydraulic pump 7 is controlled in such a way that the pressure differential $\Delta P$ is maintained to correspond to the pressure differential set value $\Delta PLS$ determined by the difference in value between the pilot pressure introduced into the first drive part 34 and the urging force of the spring 37.

In this first embodiment, based on the selective operation of the switches 141*a* and 141*b* provided in the indicating device 41 shown in FIG. 6A, electrical signals of different magnitude for single tilt operations and a dual tilt operations are sent from the controller 42 to the load sensing set pressure changeover valve 39 producing a load sensing set pressure changeover valve 39 opening area of different magnitude for single tilt operations and dual tilt operations.

In other words, where there is a wish to implement a dual tilt operation the switch 141*b* is selectively operated and, in accordance with this selection result, the load sensing set pressure changeover valve 39 opens wide. By virtue of this, a comparatively large pilot pressure is introduced into the first drive part 34 by way of the hydraulic passage 40.

In addition, where there is a wish to implement a single tilt operation the switch 141*a* is selectively operated and, in accordance with this selection result, the load sensing set pressure changeover valve 39 opens slightly. By virtue of this, a comparatively small pilot pressure is introduced into the first drive part 34 by way of the hydraulic passage 40.

As a result, when a dual tilt operation is implemented, the value of the differential set value ΔPLS decreases and a comparatively small flow is supplied from the hydraulic pump 7 to the left and right tilt cylinders 4, 5. Accordingly, the extension/retraction speed of the left and right tilt cylinders 4, 5 decreases.

On the other hand, when a single tilt operation is implemented, the value of the differential set value ΔPLS increases and a comparatively large flow is supplied from the hydraulic pump 7 to the left tilt cylinder 4. Accordingly, the extension/retraction speed of the left tilt cylinder 4 increases.

As a result of the increase in the extension/retraction speed of the left tilt cylinder 4 when a single tilt operation is implemented at low original operating speed of the blade 3 (operating speed that is half that of the dual tilt operation) and the decrease in the extension/retraction speed of each of the left and right tilt cylinders 4, 5 when a dual tilt operation is implemented at high original operating speed of the blade 3 (operating speed that is twice that of the dual tilt operation) in this way, the tilt operating speed of the blade 3 in dual tilt operations and the tilt operating speed of the blade 3 in single tilt operations can be formed to be of the same magnitude. By virtue of this, when a changeover from a dual tilt operation to a single tilt operation is implemented (or when the reverse changeover thereto is implemented), the operating speed of the blade 3 is unaltered and the discomfort associated with the alteration of the operating speed when a changeover is implemented can be alleviated. Accordingly, the operability throughout the working of the bulldozer is markedly improved.

Although the first embodiment is designed in such a way that electrical signals of different magnitude for single tilt operations and dual tilt operations are sent to the load sensing set pressure changeover valve 39, when a single tilt operation is selected by the operation of a switch 141*a*, the pressure differential set value ΔPLS may be established on the basis of the urging force of the spring 37 only without any need at all for electrical signals to be supplied to the load sensing set pressure changeover valve 39 and with the load sensing set pressure changeover valve 39 unaltered in the closed state. It should be noted that, when a dual tilt operation is selected by the operating of the switch 141*b*, electrical signals are supplied to the load sensing set pressure changeover valve 39 and the pressure differential set value ΔPLS is set in accordance with the urging force of the spring 37 and the pilot pressure added to the first drive part 34.

It should be noted that FIG. 6A provides an illustrative diagram designed for ease of description and the arrangement of the switches in the indicating device 41, and the type of switches employed, is optional.

In addition, although the constitution of the first embodiment is such that the spring 37 is arranged in the second drive part 36 and the pilot pressure is supplied to the side of the first drive part 34 side opposed thereto, a constitution may be adopted in which the first drive part 34 is arranged in the side in which the spring 37 is arranged and the pilot pressure is supplied from the load sensing set pressure changeover valve 39 to the first drive part 34.

Next, a description will be given of a second embodiment.

Although, in the first embodiment described above, switches for the selection of either a single tilt operation or a dual tilt operation are provided as an indicating device 41 (switches 141*a*, 141*b*) separately to switches 23*b*, 23*a* (dual tilt operation when switch 23*b* is OFF, and single tilt operation when switch 23*b* is OFF and switch 23*a* is OFF) of the operating lever 23, an embodiment that, interlinked with the operation of the switches 23*b*, 23*a* of the operating lever 23 and omitting the arrangement of the indicating device 41, affords the same changes in the magnitude of the ΔPLS as the first embodiment is also possible.

Figure 3:
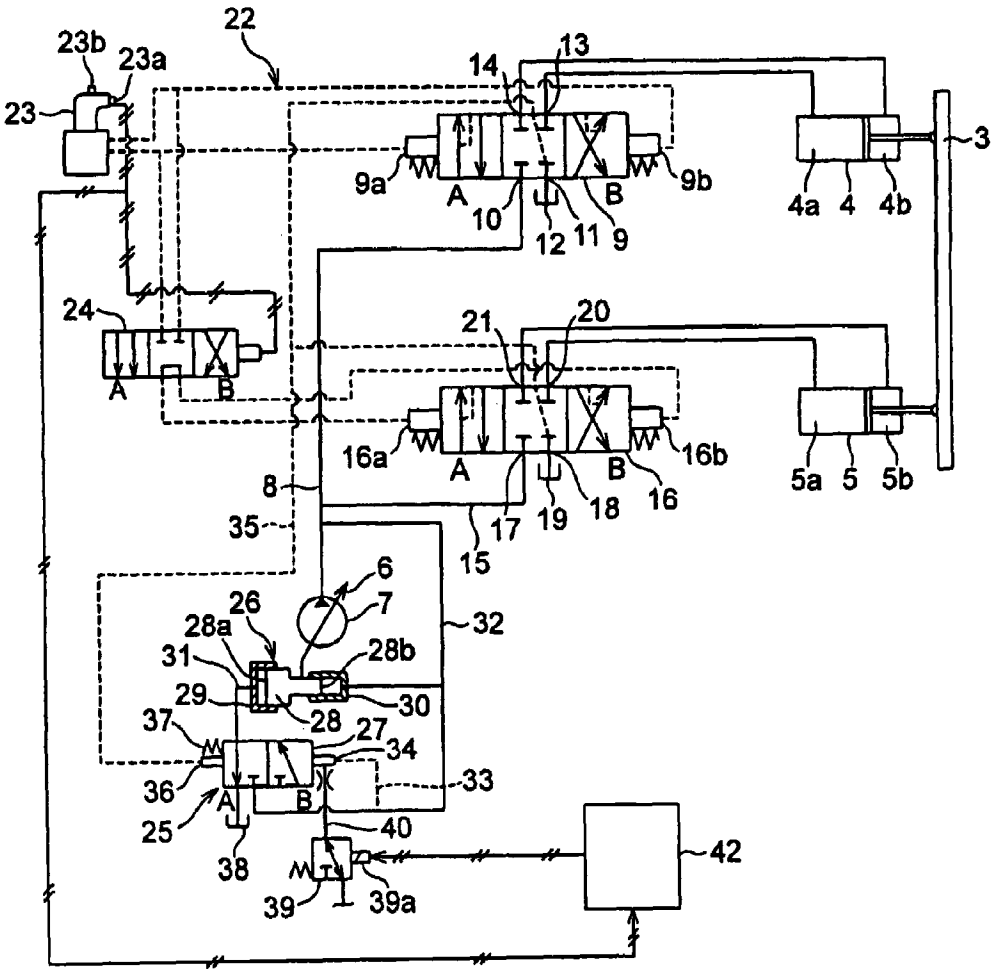
FIG. 3 is a hydraulic circuit diagram showing a second embodiment that serves as a modified example of the first embodiment.

FIG. 3 is a hydraulic circuit diagram of a second embodiment.

In FIG. 3, in which the arrangement of the indicating device 41 is omitted, electrical signals that express the operation details of the pitch dump/pitch back switch 23*a* and the dual switch 23*b* are sent to the controller 42 by way of an electrical signal line. Electrical signals are generated by the controller 42 in accordance with the operation details of the switches 23*a*, 23*b*.

In the second embodiment, electrical signals of different magnitude for when neither of switches 23*a*, 23*b* are pushed (when single tilt operation is implemented) and for when the switch 23*b* is pushed (dual tilt operation) are generated by the controller 42, and these electrical signals of different magnitude for dual tilt operations and single tilt operations are sent from the controller 42 to the load sensing set pressure changeover valve 39 producing a load sensing set pressure changeover valve 39 opening area of different magnitude for single tilt operations and dual tilt operations.

That is to say, where there is a wish to implement a dual tilt operation, the operation that is implemented involves the pushing of the dual tilt switch 23*b* of the operating lever 23. Interlinked with this operation, the load sensing set pressure changeover valve 39 opens wide. By virtue of this, a comparatively large pilot pressure is introduced into the first drive part 34 by way of the hydraulic passage 40.

In addition, where there is a wish to implement a single tilt operation, the operation (operation OFF) implemented involves neither the pushing of the pitch dump/pitch back switch 23*a* of the operating lever 23 or the switching of the dual tilt switch 23*b*. Interlinked with this operation, the load sensing set pressure changeover valve 39 opens slightly. By virtue of this, a comparatively small pilot pressure is introduced into the first drive part 34 by way of the hydraulic passage 40.

As a result, when a dual tilt operation is implemented, the value of the pressure differential set value ΔPLS decreases and a comparatively small flow is supplied to the left and right tilt cylinders 4, 5 from the hydraulic pump 7. Accordingly, the extension/retraction speed of the left and right tilt cylinders 4, 5 decreases.

On the other hand, when a single tilt operation is implemented, the value of the pressure differential set value ΔPLS increases and a comparatively large flow is supplied from the hydraulic pump 7 to the left tilt cylinder 4. Accordingly, the extension/retraction speed of the left tilt cylinder 4 increases. By virtue of this, the tilt operating speed of the blade 3 in the dual tilt operation and the tilt operating speed of the blade 3 in the single tilt operation can be formed to be of the same magnitude and, in the same way as the first embodiment, when a changeover from a dual tilt operation to a single tilt operation is implemented (or when the reverse changeover thereof is implemented), the operating speed of the blade 3 is unaltered and discomfort to the operator is alleviated. Accordingly the operability throughout the working of the bulldozer is markedly improved.

Furthermore, based on this second embodiment, because the control of the tilt operating speed of the blade is interlinked with the switches 23*a*, 23*b* provided in the operating lever 23 and is automatically implemented, indicating operations performed using the indicating device 41 are unnecessary and, accordingly, this lessens the load on the operator and eliminates indicating operation errors and indicating operation negligence.

Next, a description will be given of a third embodiment ideal for use where left and right cylinders 4, 5 of different cylinder size for machine types of a standard blade specification and machine types of a large blade specification are installed in the hydraulic circuit.

Figure 6B:
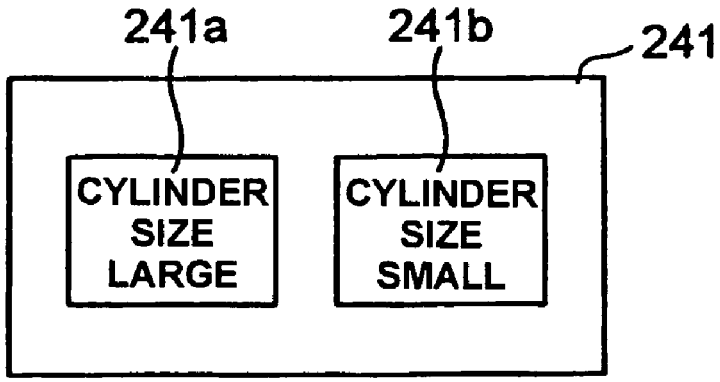

The constitution of the hydraulic circuit adopted for this third embodiment comprises, replacing the indicating device 41 of the hydraulic circuit of FIG. 1, an indicating device 241 shown in FIG. 6B.

As shown in FIG. 6B, the indicating device 241, which comprises a switch 241*a* that is selected for tilt cylinders 4, 5 of a "small cylinder size" and a switch 241*b* that is selected for tilt cylinders 4, 5 of a "large cylinder size", is selectively operated by the operator. The indicating device 241 is connected to the controller 42 by way of an electrical signal line. The controller 42 is contacted to an electromagnetic solenoid 39*a* of a load sensing set pressure changeover valve 39 by way of an electrical signal line.

When either of the switches 241*a*, 241*b* of the indicating device 241 is selectively operated electrical signals are generated by the controller 42 in accordance with the selected details thereof, and the electrical signals produced in accordance with the selected details are sent from the controller 42 to the electromagnetic solenoid valve 39*a* of the load sensing set pressure changeover valve 39. The valve position of the load sensing set pressure changeover valve 39 changes in accordance with the details selectively indicated using the indicating device 241 and, by virtue of this, the opening area changes and a pilot pressure of a magnitude in accordance with the selectively indicated details is added to the first drive part 34 of the load sensing valve 27.

When the cylinder size is small the switch 241*b* is selectively operated and, in accordance with the selection result, the load sensing set pressure changeover valve 39 opens wide. By virtue of this, a comparatively large pilot pressure is introduced into the first drive part 34 by way of the hydraulic passage 40.

In addition, when the cylinder size is large the switch 241*a* is selectively operated and, in accordance with the selection result, the load sensing set pressure changeover valve 39 opens slightly. By virtue of this, a comparatively small pilot pressure is introduced into the first drive part 34 by way of the hydraulic passage 40.

As a result, when the cylinder size is small, the value of the differential set pressure ΔPLS decreases and, based on the abovementioned equation (1) ($Q=c\cdot A\cdot\sqrt{(\Delta P)}$), a comparatively small flow Q is supplied from the hydraulic pump 7 to the left and right tilt cylinders 4, 5. Accordingly, the left and right tilt cylinders 4, 5 are operated at an extension/retraction speed that is suitable for a small size cylinder.

On the other hand, when the cylinder size is large, the value of the differential set pressure ΔPLS increases and a comparatively small flow Q is supplied from the hydraulic pump 7 to the left and right tilt cylinders 4, 5. Accordingly, the left and right tilt cylinders 4, 5 are operated at an extension/retraction speed suitable for a large size cylinder.

Based on this third invention, when bulldozers of a machine type of a standard blade specification and a machine type of large blade specification are produced, directional flow control valves 9, 16 are common to both specifications and, by the simple implementation of an indicating operation using the indicating device 241, a flow correspondent to the cylinder size of each specification can be supplied to the tilt cylinders.

Accordingly, production costs for the production of bulldozers of various machine types can be suppressed. In addition, across differing specifications, the number of manufacturing steps thereof can be reduced.

Although the description of the third embodiment is assumed to apply to tilt cylinders, it is not restricted to tilt cylinders and, in the same way for other hydraulic actuators such as lift cylinders used to lift the blade 3, a flow rate appropriate to the cylinder size can be supplied by an indicating operation using the indicating device 241.

In addition, this third embodiment can have application not only in the manufacture of bulldozers but also the manufacture of other earthmoving machinery such as hydraulic excavators. It should be noted that the indicating device 241 shown in FIG. 6B can be arranged as a hidden switch, in a location that cannot be easily operated, in such a way that it can be operated only by specific persons.

Figure 5:
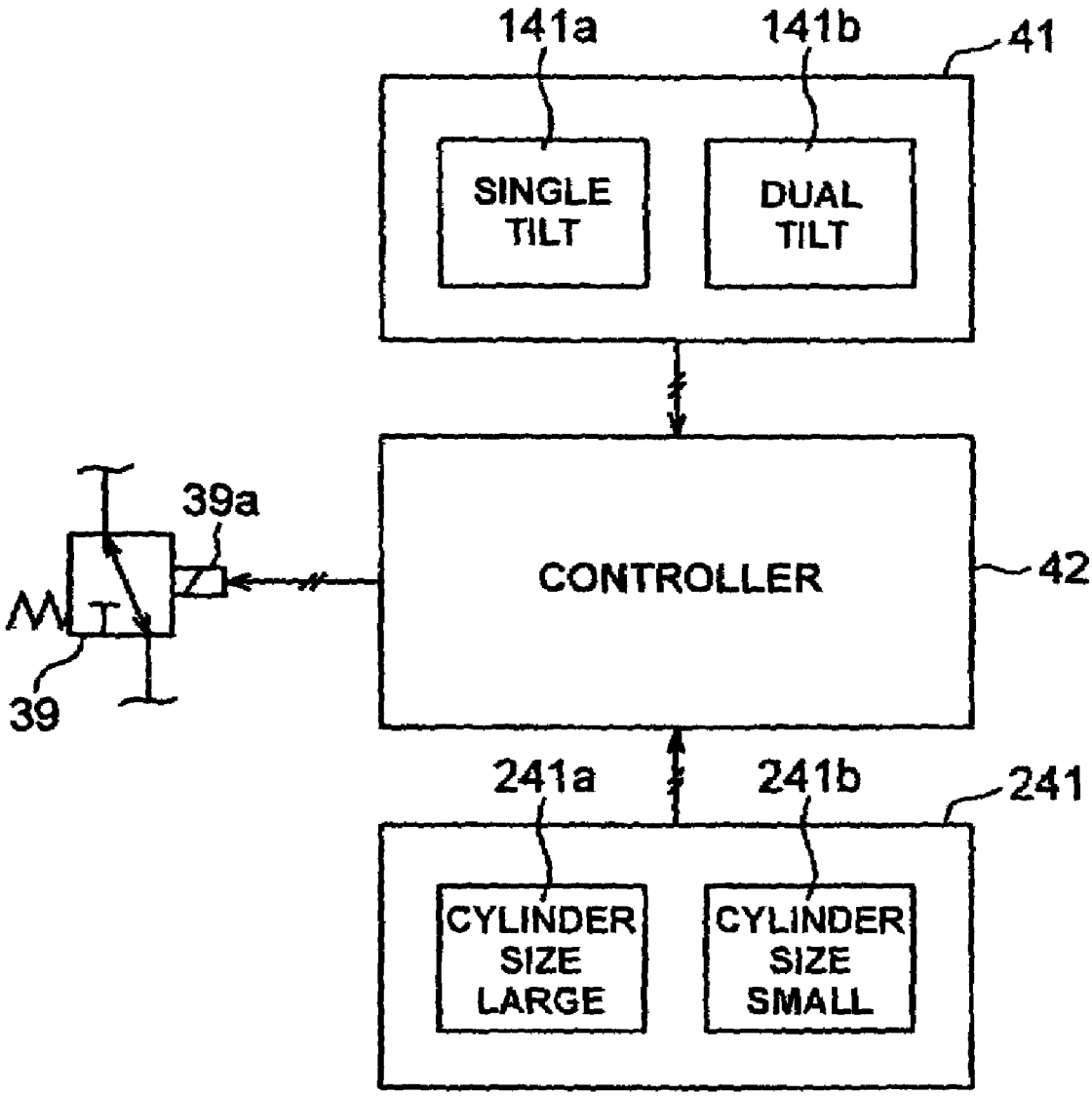
FIG. 5 is a diagram for explaining the embodiment of FIG. 4.

Next, a description will be given of a fourth embodiment that combines the first embodiment and the third embodiment. FIG. 5 shows the indicating devices 41, 241 provided in the fourth embodiment. The indicating device 41 employed here is the same as the indicating device 41 of FIG. 1. The remainder of the constitution is the same as the hydraulic circuit of FIG. 1 and, accordingly, the diagrams and explanation thereof have been omitted.

Where there is a wish to implement a dual tilt operation the switch 141*b* is selectively operated. Where there is a wish to implement a single tilt operation the switch 141*a* is selectively operated.

When the cylinder size of the tilt cylinders 4, 5 is small the switch 241*b* is selectively operated. When the cylinder size of the tilt cylinders 4, 5 is large the switch 241*a* is selectively operated.

The controller 42, based on the results of the switch selection operation, generates electrical signals that are sent to the load sensing set pressure changeover valve 39. In other words, (a) In a comparison of the selection of "single tilt" and the selection of "small cylinder size" with the selection of "single tilt" and the selection of "large cylinder size", the selection of "single tilt" and the selection of "large cylinder size" generates electrical signals that increase the value of the pressure differential set value ΔPLS.

(b) In a comparison of the selection of "dual tilt" and the selection of "small cylinder size" with the selection of "dual tilt" and the selection of "large cylinder size", the selection of "dual tilt" and the selection of "large cylinder size" generates electrical signals that increase the value of the pressure differential set value ΔPLS.

(c) In a comparison of the selection of "single tilt" and the selection of "small cylinder size" with the selection of "dual tilt" and the selection of "small cylinder size", the selection of "single tilt" and the selection of "small cylinder size" generates electrical signals that increase the value of the pressure differential set value ΔPLS.

(d) In a comparison of the selection of "single tilt" and the selection of "large cylinder size" with the selection of "dual tilt" and the selection of "large cylinder size", the selection of "single tilt" and the selection of "large cylinder size" generates electrical signals that increase the value of the pressure differential set value ΔPLS.

Accordingly, based on this fourth embodiment, the effect that combines the first invention and the third invention is produced.

In addition, the second embodiment and the third embodiment may be combined.

Figure 4:
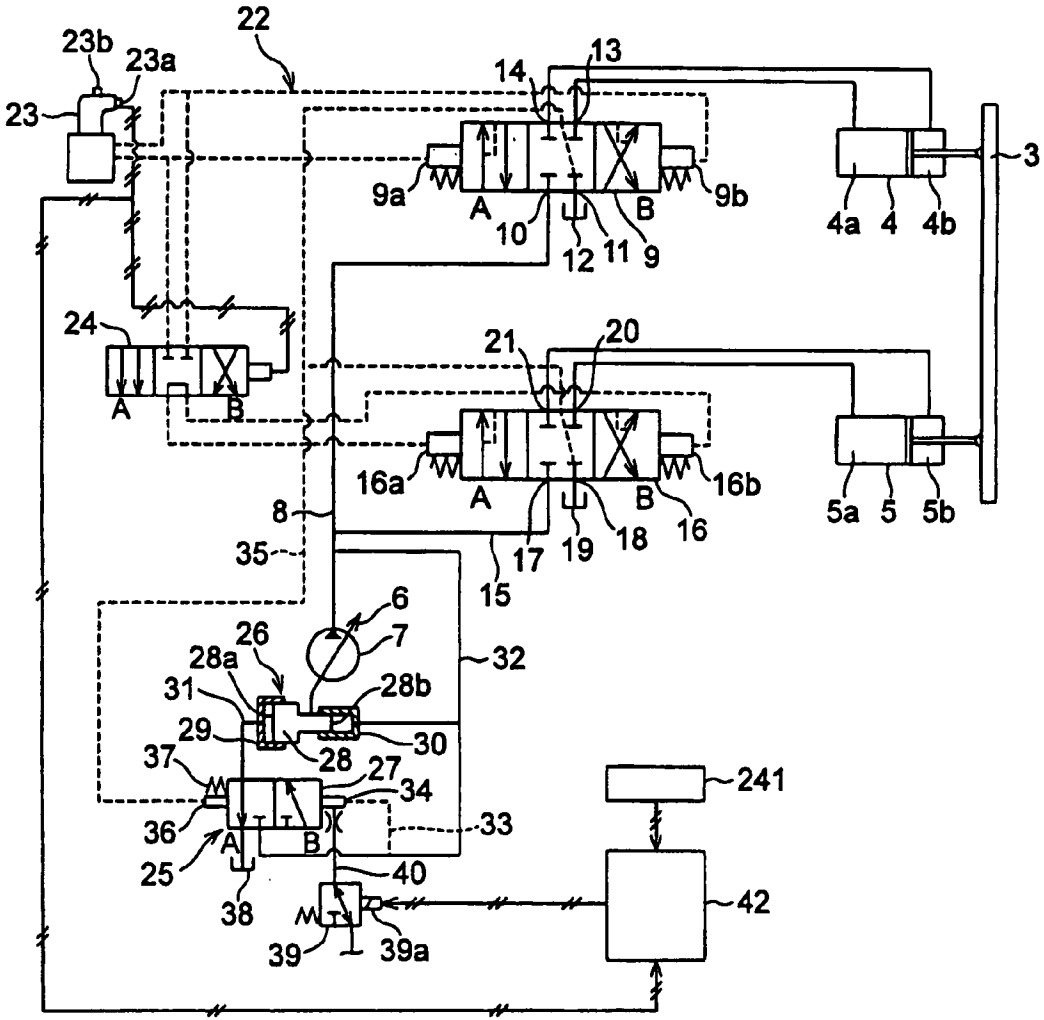
FIG. 4 is a hydraulic circuit diagram showing a fifth embodiment.

The constitution of the hydraulic circuit adopted for this fifth embodiment comprises, as shown in FIG. 4, the indicating device 241 shown in FIG. 6B replacing the indicating device 41.

That is to say, where there is a wish to implement a dual tilt operation, an operation that involves the pushing of the dual tilt switch 23*b* of the operating lever 23 is implemented, and these operation details are sent as input electrical signals to the controller 42. In addition, where there is a wish to implement a single tilt operation, an operation (operation OFF) that involves neither the pushing of the pitch dump/pitch back switch 23*a* nor the dual tilt switch 23*b* of the operating lever 23 is implemented and these operation details are sent as input electrical signals to the controller 42.

The switch 241*b* is selectively operated when the cylinder size of the tilt cylinders 4, 5 is small. In addition, the switch 241*a* is selectively operated when the cylinder size of the tilt cylinders 4, 5 is large.

The controller 42, based on the results of the switch selection operation, generates electrical signals to be sent to the load sensing set pressure changeover valve 39. In other words, (a) In a comparison of the selection of "single tilt" and the selection of "small cylinder size" with the selection of "single tilt" and the selection of "large cylinder size", the selection of "single tilt" and the selection of "large cylinder size" generates electrical signals that increase the value of the pressure differential set value ΔPLS.

(b) In a comparison of the selection of "dual tilt" and the selection of "small cylinder size" with the selection of "dual tilt" and the selection of "large cylinder size", the selection of "dual tilt" and the selection of "large cylinder size" generates electrical signals that increase the value of the pressure differential set value ΔPLS.

(c) In a comparison of the selection of "single tilt" and the selection of "small cylinder size" with the selection of "dual tilt" and the selection of "small cylinder size", the selection of "single tilt" and the selection of "small cylinder size" generates electrical signals that increase the value of the pressure differential set value ΔPLS.

(d) In a comparison of the selection of "single tilt" and the selection of "large cylinder size" with the selection of "dual tilt" and the selection of "large cylinder size", the selection of "single tilt" and the selection of "large cylinder size" generates electrical signals that increase the value of the pressure differential set value ΔPLS.

Accordingly, based on this fifth embodiment, an effect that combines the second embodiment and the third embodiment is produced.

Incidentally, depending on the earthmoving machine, a controller is provided to perform a control that changes the value of the pressure differential set value ΔPLS in accordance with a range of work types (work modes).

The sixth embodiment constitutes an embodiment by which both changes in the magnitude of the pressure differential set value and changes in the cylinder size can be dealt with in accordance with the work mode without need for replacement of the directional flow controller valve.

Figure 7:
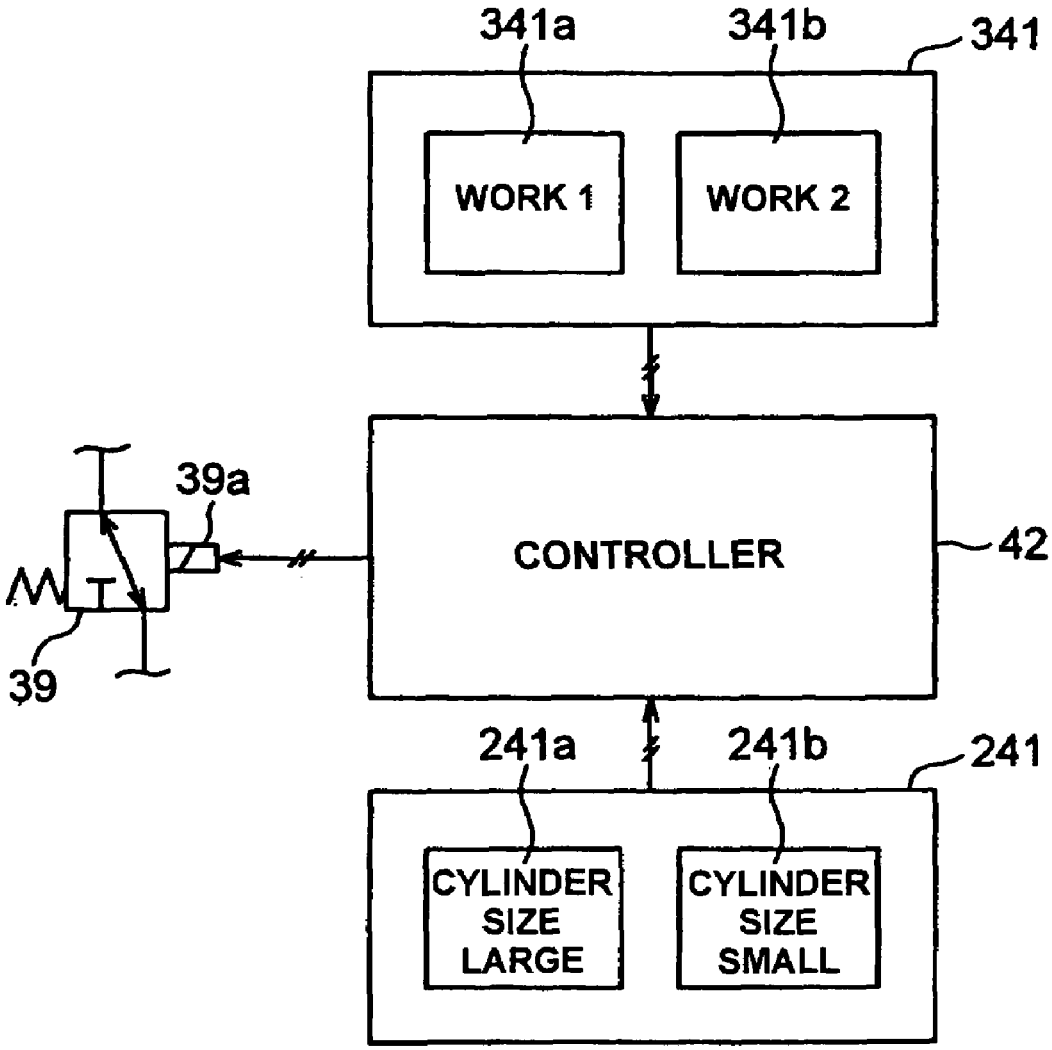
FIG. 7 is a diagram for explaining a sixth embodiment.

The constitution of the sixth embodiment shown in FIG. 7 has application in this case.

As shown in FIG. 7, this comprises an indicating device 341 replacing the indicating device 41 shown in FIG. 5. The indicating device 341, which comprises a switch 341*a* for the selecting of a "work 1" (by way of example, heavy digging) which constitutes a work type, and a switch 341*b* for the selecting of a "work 2" (by way of example, fine operation) which constitutes a work type, is selectively operated by the operator. The indicating device 341 is connected to the controller 42 by way of an electrical signal line. The "work 1" is implemented as a result of the supply of a comparatively large flow to the work cylinder and the "work 2" is implemented as a result of the supply of a comparatively small flow to the work cylinder.

Where there is a wish to implement the "work 2" a switch 341*b* is selectively operated. In addition, where there is a wish to implement the "work 1" a switch 341*a* is selectively operated.

The switch 241*b* is selectively operated when the cylinder size of the work cylinders is small. In addition, the switch 241*a* is selectively operated when the cylinder size of the work cylinders is large.

The controller 42, based on the results of the switch selection operation, generates electrical signals to be sent to the load sensing set pressure changeover valve 39. In other words, (a) In a comparison of the selection of "work 1" and the selection of "small cylinder size" with the selection of "work 1" and the selection of "large cylinder size", the selection of "work 1" and the selection of "large cylinder size" generates electrical signals that increase the value of the pressure differential set value ΔPLS.

(b) In a comparison of the selection of "work 2" and the selection of "small cylinder size" with the selection of "work 2" and the selection of "large cylinder size", the selection of "work 2" and the selection of "large cylinder size" generates electrical signals that increase the value of the pressure differential set value ΔPLS.

(c) In a comparison of the selection of "work 1" and the selection of "small cylinder size" with the selection of "work 2" and the selection of "small cylinder size", the selection of "work 1" and the selection of "small cylinder size" generates electrical signals that increase the value of the pressure differential set value ΔPLS.

(d) In a comparison of the selection of "work 1" and the selection of "large cylinder size" with the selection of "work 2" and the selection of "large cylinder size", the selection of "work 1" and the selection of "large cylinder size" generates electrical signals that increase the value of the pressure differential set value ΔPLS.

Accordingly, based on the sixth invention, the magnitude of the pressure differential set value can be changed in accordance with the work mode which facilitates, accordingly, improved work efficiency, the capacity for changes in cylinder size to be dealt with without need to replace the directional flow control valve, and the suppression of production costs and device amendment and improvement costs.

What is claimed is:

1. An oil-pressure controlling device for an earthmoving machine comprising:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with when the single tilt operation is to be performed or the dual tilt operation is to be performed, for indicating alterations of the pressure differential set value; and pressure differential set value altering means for altering the pressure differential set value in accordance with indicated details of the indicating means.

2. An oil-pressure controlling device for an earthmoving machine comprising:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

operating means for implementing the changeover operation of the changeover means;

capacity control means for controlling a capacity of the hydraulic pump in such a way that a pressure differential between a discharge pressure of the hydraulic pump and a load pressure of the tilt hydraulic actuators is maintained at a set value; and pressure differential set value altering means, interlinked with the changeover operation by the changeover means, for altering the pressure differential set value.

3. An oil-pressure controlling device for an earthmoving machine comprising:

a blade tilt-operably attached to a vehicle main body;

a pair of tilt hydraulic actuators attached to left and right of the blade;

a variable capacity hydraulic pump for supplying hydraulic oil to the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with alterations of a size of the tilt hydraulic actuators, for indicating alterations of the pressure differential set value; and pressure differential set value altering means for altering the pressure differential set value in accordance with the indicated details.

4. An oil-pressure controlling device for an earthmoving machine comprising:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

capacity control means for controlling a capacity of the hydraulic pump in such a way that a pressure differential between a discharge pressure of the hydraulic pump and a load pressure of the tilt hydraulic actuators is maintained at a set value; and first indicating means, selected in accordance with when the single tilt operation is to be performed or the dual tilt operation is to be performed, for indicating alterations of the pressure differential set value;

second indicating means, selected in accordance with alterations of a size of the tilt hydraulic actuators, for indicating alterations of the pressure differential set value; and pressure differential set value altering means for altering the pressure differential set value in accordance with indicated details of the first and second indicating means.

5. An oil-pressure controlling device for an earthmoving machine comprising:

a blade tilt-operably attached to a vehicle main body;

a pair of tilt hydraulic actuators attached to left and right of the blade;

a variable capacity hydraulic pump for supplying hydraulic oil to the tilt hydraulic actuators;

changeover means for performing changeover between a single tilt operation hydraulic passage through which hydraulic oil is supplied to one of the pair of tilt hydraulic actuators and a dual tilt operation hydraulic passage through which hydraulic oil is supplied to both of the tilt hydraulic actuators;

operating means for implementing the changeover operation of the changeover means;

capacity control means for controlling a capacity of the hydraulic pump in such a way that a pressure differential between a discharge pressure of the hydraulic pump and a load pressure of the tilt hydraulic actuators is maintained at a set value;

indicating means, selected in accordance with alterations of a size of the tilt hydraulic actuators, for indicating alterations of the pressure differential set value; and pressure differential set value altering means, interlinked with the changeover operation by the changeover means in such a way that a single tilt operation or a dual tilt operation is implemented in accordance with the size indicated by the indicating means, for altering the pressure differential set value.

6. An oil-pressure controlling device for an earthmoving machine comprising:

a variable capacity hydraulic pump for supplying hydraulic oil to working hydraulic actuators of an earthmoving machine;

capacity control means for controlling a capacity of the hydraulic pump in such a way that a pressure differential between a discharge pressure of the hydraulic pump and a load pressure of the working hydraulic actuators is maintained at a set value;

first indicating means, selected in accordance with a work content, for indicating alterations of the pressure differential set value;

second indicating means, selected in accordance with alterations of a size of the working hydraulic actuators, for indicating alterations of the pressure differential set value; and pressure differential set value altering means for altering the pressure differential set value in accordance with indicated details of the first and second indicating means.

* * * * *